US005676103A

United States Patent [19]

Tsunoda et al.

[11] Patent Number: 5,676,103

[45] Date of Patent: Oct. 14, 1997

[54] RECOIL STARTER

[75] Inventors: Shuhei Tsunoda; Mitsuo Osakabe, both of Gunma-gun; Keizo Shimizu, Annaka, all of Japan

[73] Assignee: Starting Industrial Co., LTD, Tokyo, Japan

[21] Appl. No.: 638,806

[22] Filed: Apr. 29, 1996

[30] Foreign Application Priority Data

| | | | |
|---|---|---|---|
| May 9, 1995 | [JP] | Japan | 7-135899 |
| May 9, 1995 | [JP] | Japan | 7-135900 |
| May 9, 1995 | [JP] | Japan | 7-135901 |
| Mar. 5, 1996 | [JP] | Japan | 8-75198 |
| Mar. 5, 1996 | [JP] | Japan | 8-75199 |

[51] Int. Cl.[6] ..... F02N 3/02

[52] U.S. Cl. ..... 123/185.3

[58] Field of Search ..... 123/185.2, 185.3, 123/185.4

[56] References Cited

U.S. PATENT DOCUMENTS

| | | | |
|---|---|---|---|
| H517 | 9/1988 | Sato et al. | 123/185.2 |
| 2,848,987 | 8/1958 | Morden | 123/185.3 |
| 3,375,814 | 4/1968 | Hamman | 123/185.2 |
| 4,492,190 | 1/1985 | Greenwood et al. | 123/185.2 |

*Primary Examiner*—Andrew M. Dolinar
*Attorney, Agent, or Firm*—Laurence R. Brown

[57] ABSTRACT

A recoil starter is provided which prevents malfunction, such as disengagement of a claw, after the engine is started repeatedly even if the starter is not made of a material of high intensity. A spring can be wound substantially precisely circularly. It is quite easy to mount a friction plate to the starter. Furthermore, this subassembly does not loosen after long-term usage. A rope guide can be easily mounted to the starter case, thus reducing the fabrication cost. The recoil starter can be placed and locked in position relative to a fan cover with high accuracy. When the ratchet is in its protruded position, the pivotal point of the ratchet is located radially inside a pulley around the position where the pulley engages the ratchet. A ratchet support portion is formed radially outside the pulley on the reel. The ratchet forms a beam supported at its both ends. The beam acts against a force exerted by the pulley due to a resistance produced when the engine is started. A cover is mounted at the top end of the support portion to prevent the ratchet from moving toward the top end of the ratchet. A cylindrical engaging portion is formed on the outer surface of the stem of the starter case. One end of the spring engages this engaging portion. A rope takeout port is formed in the outer surface of the case such that the rope is payed out while tilted upwardly from a horizontal plane. The rope guide made of a hard material and acting to guide the rope is fitted over the case between the rope takeout port and the reel.

7 Claims, 7 Drawing Sheets

PRIOR ART

RECOIL STARTER

BACKGROUND OF THE INVENTION

1. Field of the Invention

The present invention relates to a recoil starter used to start an engine.

2. Description of the Prior Art

One known recoil starter has been proposed by us and is disclosed in Japanese Utility Model Publication No. 48778/1980. As shown in FIGS. 9, 10(*a*), and 10(*b*), this recoil starter has a resinous starter case, indicated by numeral 21. A stem 22 is rigidly attached to the axial center of the starter case 21. A reel 23 is rotatably mounted to the stem 22. The reel 23 is provided with a groove 23*a* in its outer surface. A rope 24 is wound inside the groove 23*a* by restoring force of a spring 25.

As shown in FIGS. 10(*a*) and 10(*b*), a ratchet 26 is mounted to the reel 23. A pin 26' is firmly secured at an intermediate position of the ratchet 26. The ratchet 26 can move between an inclined surface 28 formed near the outer fringe of the reel 23 and a protruding surface 35, and is mounted to the reel 23. A friction plate 27 is mounted to the stem 22 and has a guide portion which is moved back and forth radially by guiding the ratchet 26.

A pulley 29 connected with an engine is mounted on the side of the engine. A hole 29*a* is formed at the front end of the outer surface of the pulley 29. The reel 23 is provided with a protrusion 30 near the outer surface of the pulley 29. The rear surface of the front end of the ratchet 26 bears against the protrusion 30.

In the known recoil starter of this construction, when the starter is at rest as shown in FIG. 10(*a*), if the rope 24 is pulled out against the restoring force of the spring 25, the friction between the friction plate 27 and a friction spring 28 maintains the friction plate 27 stationary. The reel 23 and the ratchet 26 are rotated. Therefore, the ratchet 26 is guided by the guide portion of the friction plate 27 that is at rest. Then, as shown in FIG. 10(*b*), the ratchet 26 is made to protrude and is engaged in the hole 29*a* in the pulley 29. This rotates the pulley 29, thus starting the engine.

After the engine has been started, if the rope 24 is released, the restoring force of the spring 25 rotates the reel 23 in a reverse direction, thus taking up the rope 24. At the same time, the ratchet 26 is retracted and returns into its original position.

During this operation, when the ratchet 26 is rotated by the reel 23 and caused to protrude, the load imposed on the ratchet 26 by the engagement with the pulley 29 is received by the protruding surface 35 in the center of the front end of the ratchet 26. The load is also received by the rear surface 32 of the front end of the ratchet 26 on the protrusion 30. Since the load imposed on the ratchet 26 is sustained by both protruding surface 35 and protrusion 30, the surface pressure is halved. For this reason, even if the recoil starter is not made large in size, the engine can be cranked stably and smoothly without damaging the ratchet 26.

Another recoil starter of this kind is described in Japanese Utility Model Publication No. 31576/1990. As shown in FIG. 12, this starter has a starter case 21'. A stem 22' is firmly mounted at the axial center of the starter case 21'. A reel 23' is rotatably mounted to the stem 22'. A groove 23'*a* is formed in the outer surface of the reel 23'. A rope 24' is coiled in the groove 23'*a* by restoring force of a spring 25'.

A ratchet 26' is mounted to the reel 23'. A pin 26" is firmly secured at an intermediate position of the ratchet 26'. The ratchet 26' can move between an inclined surface formed near the outer surface of the reel 23' and a protruding surface, and is mounted to the reel 23'. A friction plate 27' is mounted to the stem 22' and has a guide portion which is moved back and forth radially by guiding the ratchet 26'. The guiding movement of the ratchet 26' is made by guiding the pin 26".

A lower hole 22'*a* is formed in the stem 22'. A thread is formed in the wall defining the lower hole 22'*a*. A bolt 42 having ahead 42*a* is screwed into the lower hole 22'*a*. The head 42*a* locks and holds the friction plate 27'.

Meanwhile, on the side of the engine, there is provided a pulley 29' connected with the engine. A recess is formed at the front end of the outer surface of the pulley.

In this known recoil starter of this construction, when the starter is at rest, if the rope 24' is pulled out against the restoring force of the spring 25', the friction between the friction plate 27' and the stem 22' maintains the friction plate 27' stationary. The reel 23' and the ratchet 26' are rotated. Therefore, the pin 26" on the ratchet 26' is guided by the guide portion of the friction plate 27'. The ratchet 26' is made to protrude radially and is fitted in the recess formed in the pulley 29'. This rotates the pulley, thus starting the engine.

After the engine has been started, if the rope 24' is released, the restoring force of the spring 25' rotates the reel 23' in a reverse direction. The rope 24' is rewound. Also, the ratchet 26' is moved back into its original position.

In the case of the known recoil starter described in connection with FIGS. 9, 10(*a*), and 10(*b*), pulling of the rope 24 for starting the engine is smoothly done without damaging the ratchet 26. In recent years, however, in an attempt to reduce the cost of the recoil starter, the reel 23 and the ratchet 26 have tended to be molded out of a resin which does not have sufficiently high rigidity. In this case, as the engine is operated repeatedly, deformation of components, especially the protrusion 30 and the rear surface 32 at the front end of the ratchet 26, is conceivable. If such a deformation occurs, when the ratchet 26 bears against the protrusion 30, the ratchet 26 tilts toward the engine in a direction perpendicular to one surface of the reel 23. As a result, there is the possibility that the ratchet 26 comes off. Hence, there is a demand for a countermeasure against this problem.

Also in this recoil starter, as shown in FIG. 13, the spring 25 is wound substantially elliptically around the solid stem 22 and around a hook 25*a*. Consequently, a part of the spring 25 is curved at a small radius of curvature, so that this part is made to break off. In this way, the durability presents problems. Furthermore, the diameter of the stem 22 is restricted by the presence of the hook 25*a*. Thus, the rigidity of the stem 22 poses problems.

In the known recoil starter described in conjunction with FIG. 12, the head 42*a* of the bolt 42 screwed into the lower hole 22'*a* in the stem 22' locks and holds the friction plate 27'. Therefore, it is cumbersome to tighten the bolt 42. Furthermore, since the recoil starter is used in high-temperature environment, as the engine is started repeatedly, the bolt 42 is loosened. The pin 26" on the ratchet 26' in the guide portion formed on the friction plate 27' is guided unstably. As a result, when the rope 24' is pulled out, the engine may not be stably and smoothly started.

In this recoil starter, pulling of the rope 24' for starting the engine is smoothly done without wearing or damaging the starter case 21'. However, an opening 40 must be formed in the starter case 21' as shown in FIG. 11. A rope guide 41 fabricated separately must be inserted into this opening 40.

Then, the rope guide must be crimped against the opening. In this way, cumbersome operations are necessary. This is one of factors of fabrication cost rise. In addition, in this known recoil starter, the outer surface of the starter case 21' is mounted to a fan cover 36 with a bolt 36*a* and a nut 36*b*. As the engine is repeatedly started with the recoil starter, the tightening by the bolt 36*a* and nut 36*b* weakens. As a result, when the rope 24' is pulled out, the recoil starter is swung. This makes it impossible to start the engine stably and smoothly.

SUMMARY OF THE INVENTION

It is an object of the present invention to provide a recoil starter having a claw which does not come off after the engine is started repeatedly even if the starter is not made of a material of high strength.

It is another object of the invention to provide a recoil starter having a spring which can be wound into a rather precise circle.

It is a further object of the invention to provide a recoil starter which permits a friction plate to be mounted to the starter quite easily and which does not permit any component to be shifted out of position after used for a long time.

It is a yet other object of the invention to provide a recoil starter which permits a rope guide to be mounted to the starter case of the recoil starter by a simple operation, thus reducing the fabrication cost.

It is a still other object of the invention to provide a recoil starter capable of being placed in position relative to a fan cover with high accuracy and being firmly mounted to the fan cover.

A first embodiment of the invention is a recoil starter comprising: a starter case mounted to an engine and having a stem; a reel rotatably mounted to the stem of the starter case and having an outer surface provided with a groove; a rope received in the groove; a rope takeout port formed in the starter case; a spring having a first end engaging the reel and a second end engaging the starter case, the spring acting to bias the reel in such a direction that the rope payed out from the rope takeout port is taken up; a rotatable starting pulley mounted at a side of the engine; a ratchet capable of rotating between its protruded position and its retracted position, the ratchet being fitted in such a way as to engage the pulley at the protruded position; a friction plate for causing the ratchet to be protruded or retracted; a friction spring biased against the ratchet so that the ratchet is frictionally rotated; a boss mounted at a center of the stem of the starter case; a set screw mounted to the boss; a ratchet guide mounted to the set screw to assemble the whole starter; a pivotal point about which the ratchet rotates, the pivotal point being located radially inside the pulley, the pivotal point being located around a position where the ratchet engages the pulley when the ratchet is in the protruded position; a ratchet support portion formed on the reel and located radially outside the pulley; a beam supported at its both ends, the beam being formed by the ratchet, the beam acting against a force of the pulley created by a resistance produced when the engine is started; and a cover mounted at a top end of the support portion to prevent the ratchet from moving toward a top end of the ratchet.

In this structure, the pin is mounted to the ratchet between its pivotal point and its front end. The friction plate is provided with a substantially radial guide portion and also with a continuing arcuate wall to cause the ratchet to be either protruded or retracted. The guide portion guides the pin and causes the ratchet to be protruded or retracted. The arcuate wall extends around the stem of the starter case and acts to prevent the ratchet from popping out. A ratchet support portion is formed between the cover at the top end of the ratchet support portion of the reel and the reel. Preferably, the inner surface of the cover tapers off such that the ratchet support portion widens outward.

A second embodiment of the invention is a recoil starter comprising: a starter case mounted to an engine and having a stem; a reel rotatably mounted to the stem of the starter case and having an outer surface provided with a groove; a rope received in the groove; a rope takeout port formed in the starter case; a spring having a first end engaging the reel and a second end engaging the starter case, the spring acting to bias the reel in such a direction that the rope payed out from the rope takeout port is taken up; a rotatable starting pulley mounted at a side of the engine; a ratchet capable of rotating between its protruded position and its retracted position, the ratchet being fitted in such a way as to engage the pulley at the protruded position; a friction plate for causing the ratchet to be protruded or retracted; a friction spring biased against the ratchet so that the ratchet is frictionally rotated; a boss mounted at a center of the stem of the starter case; a set screw mounted to the boss; a ratchet guide mounted to the set screw to assemble the whole starter; a cylindrical engaging portion formed on an outer surface of the stem of the starter case, the spring having an end engaging the engaging portion.

In this structure, the stem is provided with a recess formed by a slit. A spring engages one of two opposite walls defining the slit. A tongue portion for guiding the spring engages the other wall. The tongue portion is tilted inwardly of the stem. The set screw has a head of increased diameter and a stem. A plurality of annular protrusions are formed on the outer surface of the stem. A boss is formed in the center of the stem of the starter case. The boss is provided with a lower hole. Preferably, the set screw is mounted with a press fit in the lower hole.

A third embodiment of the invention is a recoil starter comprising: a starter case mounted to an engine and having a stem; a reel rotatably mounted to the stem of the starter case and having an outer surface provided with a groove; a rope received in the groove; a rope takeout port formed in the outer surface of the starter case such that the rope is payed out from the rope takeout port while tilted upwardly from a horizontal plane; a spring having a first end engaging the reel and a second end engaging the starter case, the spring acting to bias the reel in such a direction that the rope payed out from the rope takeout port is taken up; a rotatable starting pulley mounted at a side of the engine; a ratchet capable of rotating between its protruded position and its retracted position, the ratchet being fitted in such a way as to engage the pulley at the protruded position; a friction plate for causing the ratchet to be protruded or retracted; a friction spring biased against the ratchet so that the ratchet is frictionally rotated; a boss mounted at a center of the stem of the starter case; a set screw mounted to the boss; and a rope guide made of a hard material and fitted over the starter case between the rope takeout port and the reel.

In this structure, a disengagement-preventive member for preventing the rope from coming off the reel is preferably formed integrally with the starter case between the rope guide and the reel. A faucet joint for placing the starter case in position relative to the engine is mounted at the position where the starter case is mounted to the engine. A plastic fastener is fitted into the central position of the faucet joint, thus mounting the starter case to the engine.

Other objects and features of the invention will appear in the course of the description thereof, which follows.

BRIEF DESCRIPTION OF THE DRAWINGS

FIG. 7(*b*) is a front elevation of the rope guide shown in FIG. 6;

FIG. 10(*b*) is a view similar to FIG. 10(*a*), but in which the ratchet is engaged;

DETAILED DESCRIPTION OF THE PREFERRED EMBODIMENTS

Figure 1:
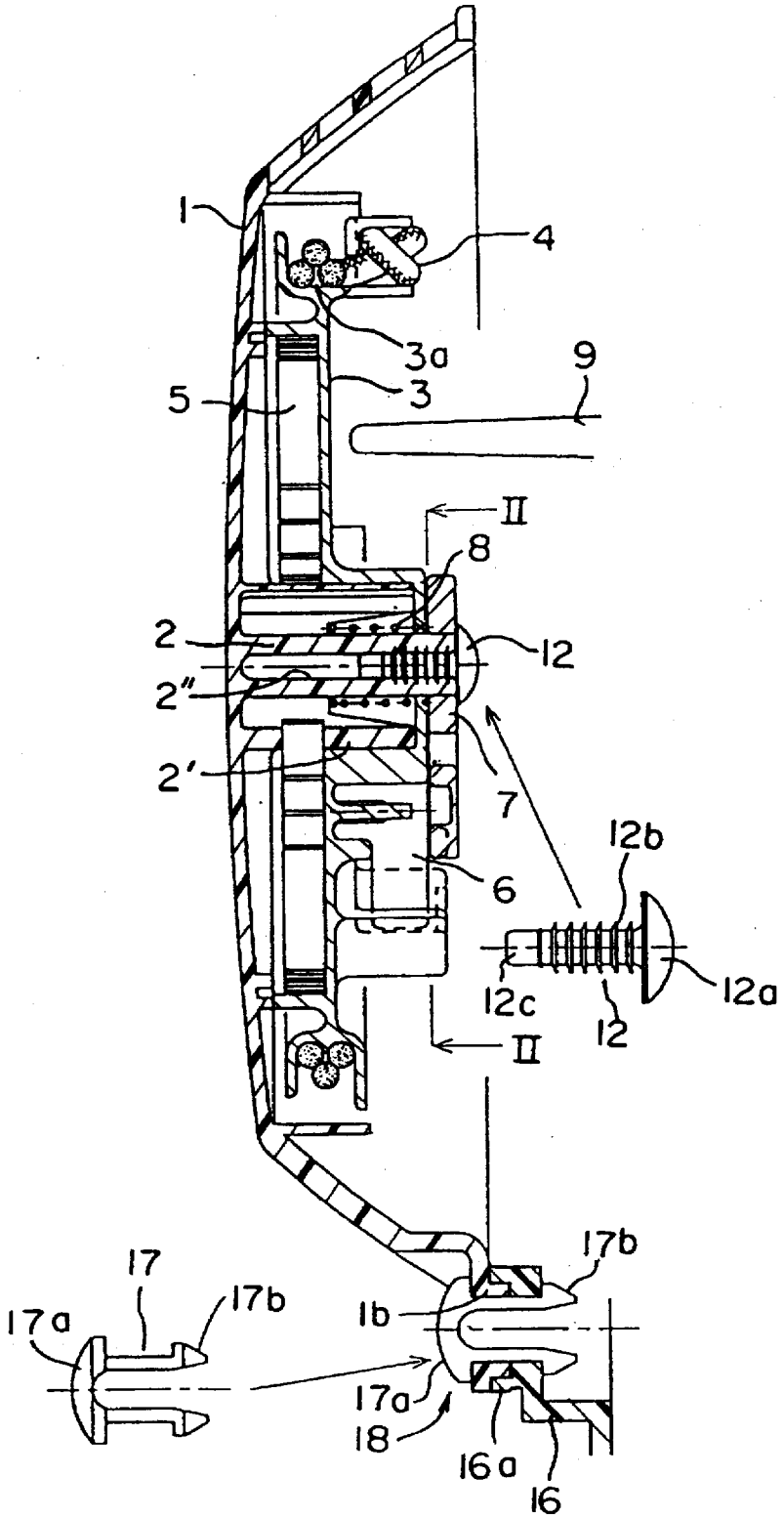
FIG. 1 is a vertical cross section of a recoil starter according to the present invention.

Referring to FIGS. 1–8, there is shown a recoil starter embodying the concept of the present invention. This recoil starter comprises a resinous starter case 1 having a stem 2 mounted in its center. A reel 3 is rotatably mounted to the stem 2. A groove 3*a* is formed in the outer surface of the reel 3, and a rope 4 is received in the groove 3*a*. A knob (not shown) is attached to one end of the rope 4 to permit one to pull the rope with his or her hand. One end of a spring 5 engages the reel 3, while the other end engages the stem 2 of the starter case. The spring 5 biases the rope 4 in the direction to take it up. A ratchet 6 is pivotally mounted to the reel 3 and capable of rotating between its protruded position and its retracted position. In the protruded position, the ratchet 6 engages the engaging portion of a pulley 9. A friction plate 7 is mounted to the front end of the stem 2 to cause the ratchet 6 to be protruded or retracted. A friction spring 8 produces friction between the stem 2 and the friction plate 7. A protrusion 10 is formed near the outer surface of the reel 3. A cover 11 for limiting movement of the ratchet 6 in the direction perpendicular to the surface of the reel 3 is formed integrally with the protrusion 10. A set screw 12 has a head 12*a* of increased diameter and a stem 12*c*. A plurality of annular protrusions 12*b* are formed on the outer surface of the stem 12*c*. The set screw 12 is mounted with a press fit in a lower hole 2" formed in the stem 2 by ramming the screw into the hole. A rope takeout port 13 is formed in the outer surface of the starter case to permit the rope 4 to be taken out from the outer surface of the reel 3 such that the rope 4 is inclined upwardly from the horizontal surface. A rope guide 14 is fitted over the starter case 1 between the rope takeout port 13 and the reel 3, and made of a hard material to guide the rope 4. A disengagement-preventive member 15 is formed integrally with the starter case between the rope guide 14 and the reel 3 to prevent the rope 4 from coming off the reel 3. A faucet joint 18 places the resinous fan cover 16 and the starter cover in position at the position where the resinous fan cover 16 is mounted to the starter case 1. A plastic fastener 17 is pressed against the center of the faucet joint 18 and mounts the starter case 1 to the fan cover 16.

In this novel structure, the cover 11 for preventing the ratchet 6 from being moved toward the engine, i.e., in a direction perpendicular to the plane of rotation of the reel 3, is formed integrally with the protrusion 10 which is formed near the outer surface of the reel 3. If the protrusion 10 and the ratchet 6 are deformed slightly by repeated starting of the engine, the ratchet 6 is prevented from moving toward the engine past the protrusion 10; otherwise the ratchet 6 would be brought out of the hole 9*a* formed in the pulley 9.

When the engine is not operated, if the rope 4 is pulled out against the restoring force of the spring 5, the friction plate 7 is kept stationary by the friction between the friction plate 7 and the friction spring 8, while the reel 3 and the ratchet 6 are rotated, in the same way as in the prior art recoil starter. Therefore, a pin mounted to the ratchet 6 pivoted to a claw-sustaining portion 6*a* of the reel 3 is guided by both an arcuate wall 7*b* and a substantially radial guide portion 7*a*. The claw-sustaining portion 6*a* is located radially inside the pulley 9 and forms a pivotal point. The arcuate wall 7*b* and the guide portion 7*a* are formed on the rear surface of the friction plate 7, in the same way as in the technique described in Japanese Utility Model Laid-Open No. 125670/1986. A pin 6' mounted on the ratchet 6 is guided by the arcuate wall 7*b* and by the guide portion 7*a*. The ratchet 6 is rotated about the claw-sustaining portion 6*a* at rest and made to protrude. Then, the ratchet 6 is brought into engagement with the hole 9*a* in the pulley 9. As a result, the engine is cranked. At this time, a load is impressed on the ratchet 6 by the engagement with the hole 9*a* in the pulley 9. This load is received by abutment with the claw-sustaining portion 6*a* around the center of the front end of the ratchet 6. At the same time, the load is received by abutment with the protrusion 10 on the rear surface 6*b* at the front end of the ratchet 6. Hence, the ratchet 6 acts as a beam supported at its both ends against the force applied from the pulley 9. Consequently, the load imposed on the ratchet 6 is dispersed and lowered.

After the engine has been started, if the rope 4 is released, the restoring force of the spring 5 rotates the reel 3 in the reverse direction. The rope 4 is taken up and, at the same time, the ratchet 6 is restored to its original position.

In this case, if the engine is repeatedly started and the ratchet 6 repeatedly comes into abutting engagement with the claw-sustaining portion 6*a* and with the protrusion 10 to thereby slightly deform the front end of the ratchet 6 and the protrusion 10, the ratchet 6 is prevented from moving toward the engine, i.e., in a direction vertical to the plane of rotation of the reel 3, because the protrusion 10 is provided with the cover 11; otherwise the ratchet 6 would come off the hole 9*a* formed in the pulley 9.

Figure 3A:
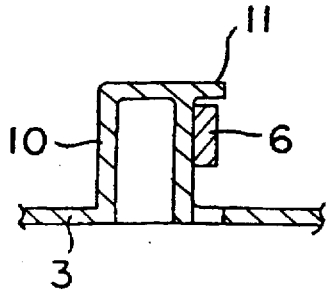
FIGS. 3(*a*) and 3(*b*) are cross-sectional views both taken on line III—III of FIG. 2, but showing different examples.
Figure 3B:
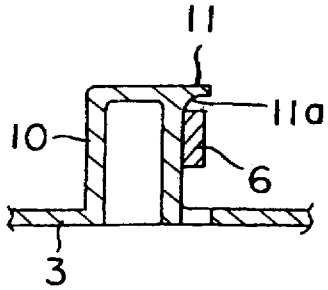
Figure 4:
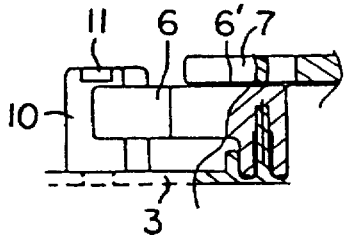
FIG. 4 is a partially cutaway view taken in the direction indicated by the arrow IV in FIG. 2.

The inner surface 11*a* of the cover 11 of the protrusion 10 preferably tapers such that a ratchet-receiving portion formed between the cover 11 and the reel 3 widens outwardly, as shown in FIG. 3(*b*).

In this way, in the novel structure, even if the reel 3 and the ratchet 6 are not made of a hard material, the ratchet 6 is prevented from coming out of the hole 9a in the pulley 9 after repeated operation. Thus, malfunction is prevented. In this way, a long-lived recoil starter operating stably can be manufactured at low cost.

Figure 2:
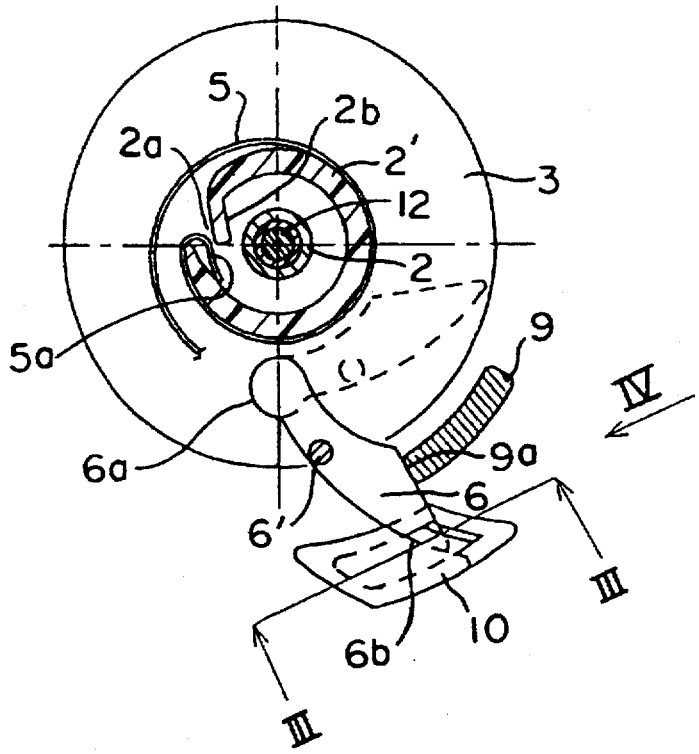
FIG. 2 is a schematic plan view of the ratchet of the recoil starter shown in FIG. 1.

In this structure, a cylindrical engaging portion 2' spaced from the outer surface of the stem 2 of the starter case 1 is preferably provided. The engaging portion 2' is preferably provided with a slit 2a, as shown in FIG. 2. In this case, if a hook portion 5a formed at one end of the wound spring 5 is made to engage the slit 2a, then the spring 5 is wound substantially precisely circularly around the cylindrical engaging portion 2'.

Figure 8:
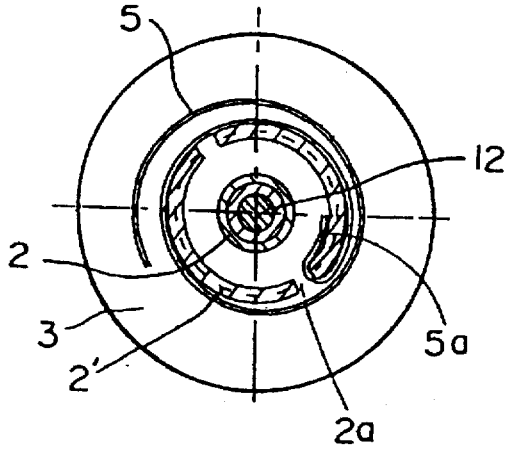
FIG. 8 is a view similar to FIG. 2, but showing another example of the ratchet.
Figure 9:
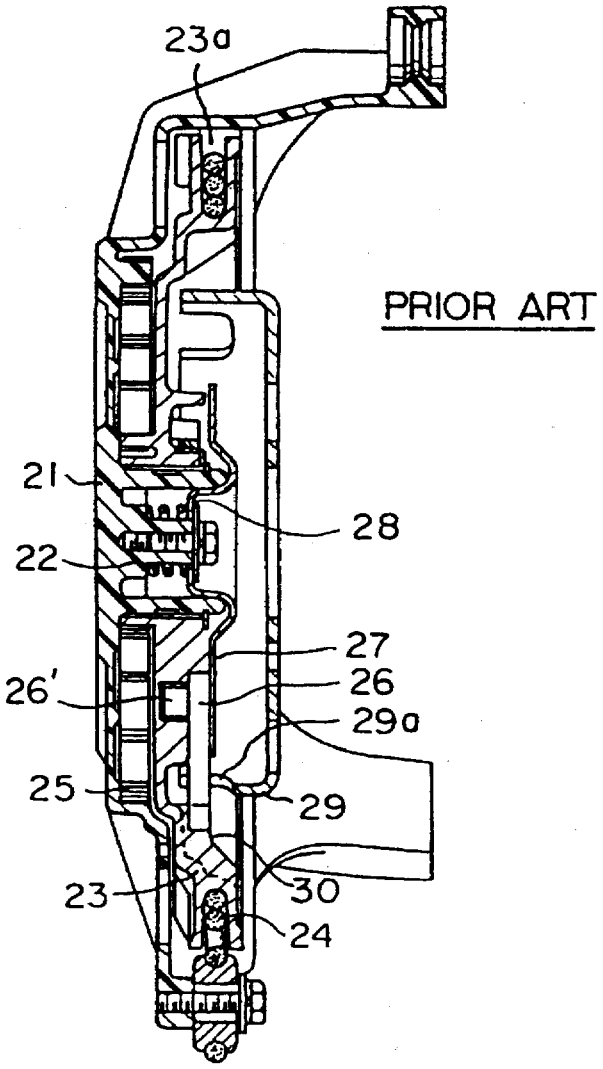
FIG. 9 is a vertical cross section of a known recoil starter.
Figure 10A:
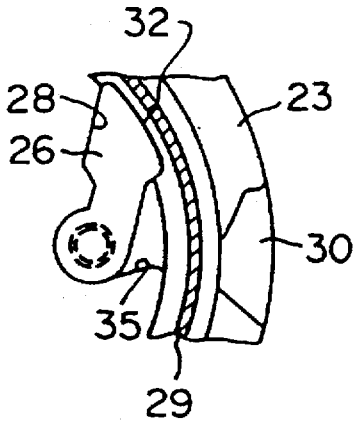
FIG. 10(*a*) is a fragmentary view of the ratchet shown in FIG. 9, and in which the ratchet is at rest.
Figure 10B:
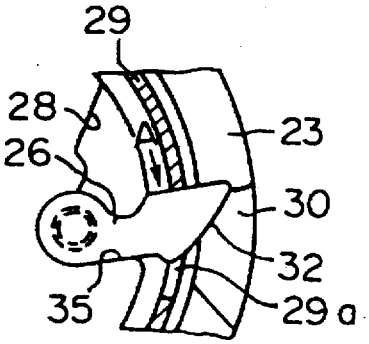
PRIOR ART Fig. 10(b)
Figure 11:
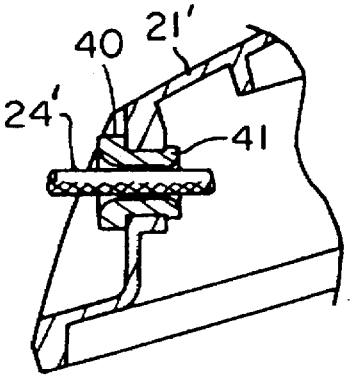
PRIOR ART Fig. 11
FIG. 11 is an enlarged cross section of a rope takeout port formed in another known recoil starter shown in FIG. 12.
Figure 12:
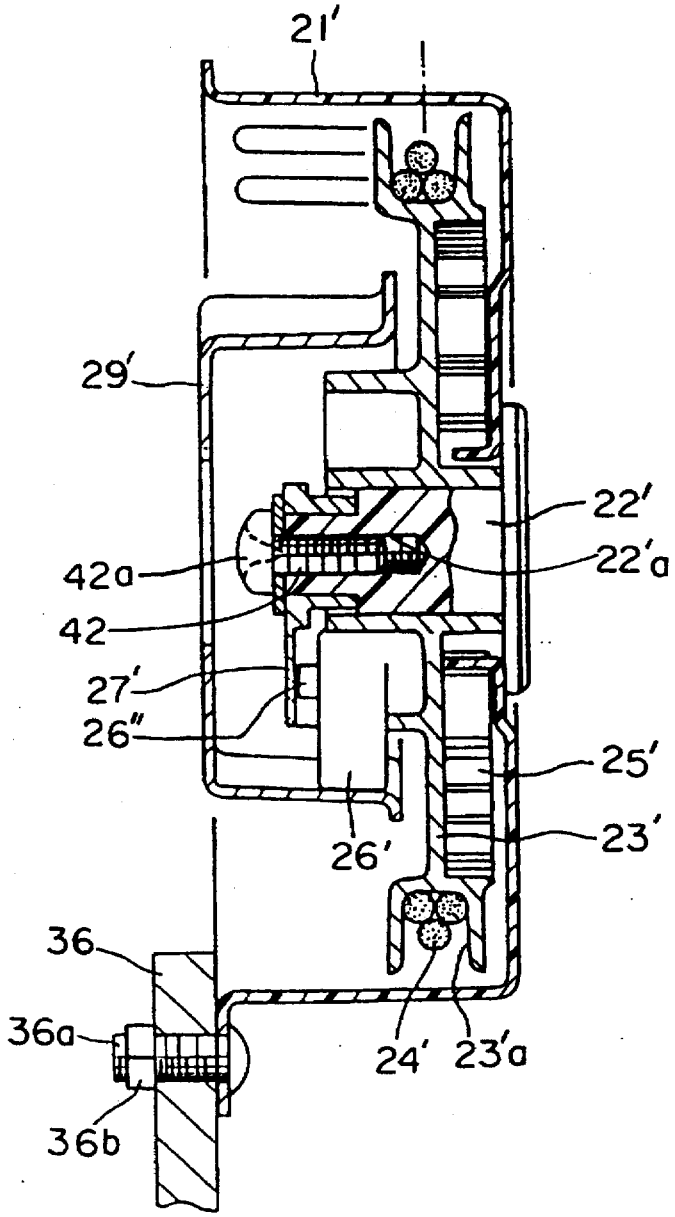
Fig. 12 PRIOR ART
FIG. 12 is a vertical cross section of the known recoil starter.
Figure 13:
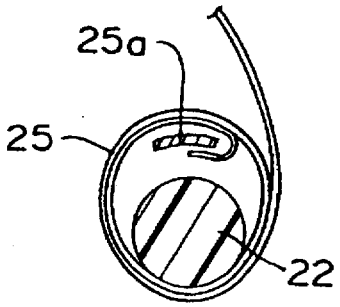
Fig. 13 PRIOR ART
FIG. 13 is a fragmentary cross-sectional view of the recoil starter shown in FIG. 12, and in which the stem and the hook of the spring are at rest.

If the wall 2b opposite to the wall engaged by the hook portion 5a of the spring 5 is tilted inwardly toward the stem 2, then the spring 5 can be smoothly guided. A wall tilted inward toward the stem, as shown in FIG. 8, is not necessary.

In this way, in the novel structure, the slit 2a is formed in the cylindrical engaging portion 2'. The hook portion 5a formed at one end of the wound spring 5 engages the slit 2a. Therefore, the spring 5 is wound around the engaging portion 2' substantially precisely circularly, thus eliminating a portion of a small radius of curvature. Consequently, the spring 5 is prevented from breaking. This improves the durability. If starting of the engine by pulling out the rope 4 is repeated, the spring 5 does not deteriorate. Hence, the operating life through which the engine is started stably and smoothly is prolonged. Furthermore, the diameter of the starter can be increased without increasing the weight, because a space exists between the stem 2 of the starter and the engaging portion 2'. As a consequence, the strength can be enhanced. The engaging portion may also be constituted by forming a slot instead of the slit 2a.

In the present invention, the starter case 1 is molded out of a resin. As shown in FIG. 1, a solid boss is formed at the center of the stem 2. The lower hole 2" is formed in the boss. The set screw 12 made of a metal or hard resin is forced into the lower hole 2", the screw 12 having the enlarged head 12a and the stem 12c. The annular protrusions 12b are formed on the outer surface of the stem 12c. Thus, the friction plate 7 is locked. The friction spring 8 is disposed between the friction plate 7 and the starter case 1.

Since the recoil starter is constructed as described above, the lower hole 2" formed in the resinous boss is brought into firm engagement with the annular protrusions 12b of the rammed set screw 12. The friction plate 7 which is made to produce increased friction by the friction spring 8 is strongly pushed by the set screw 12 and locked. Therefore, even if the engine is started repeatedly by pulling out the rope 4, the positional relation of the friction plate 7 to the recoil starter does not age. The engine can be started stably and smoothly by pulling out the rope 4. This can be repeated many times.

Figure 5:
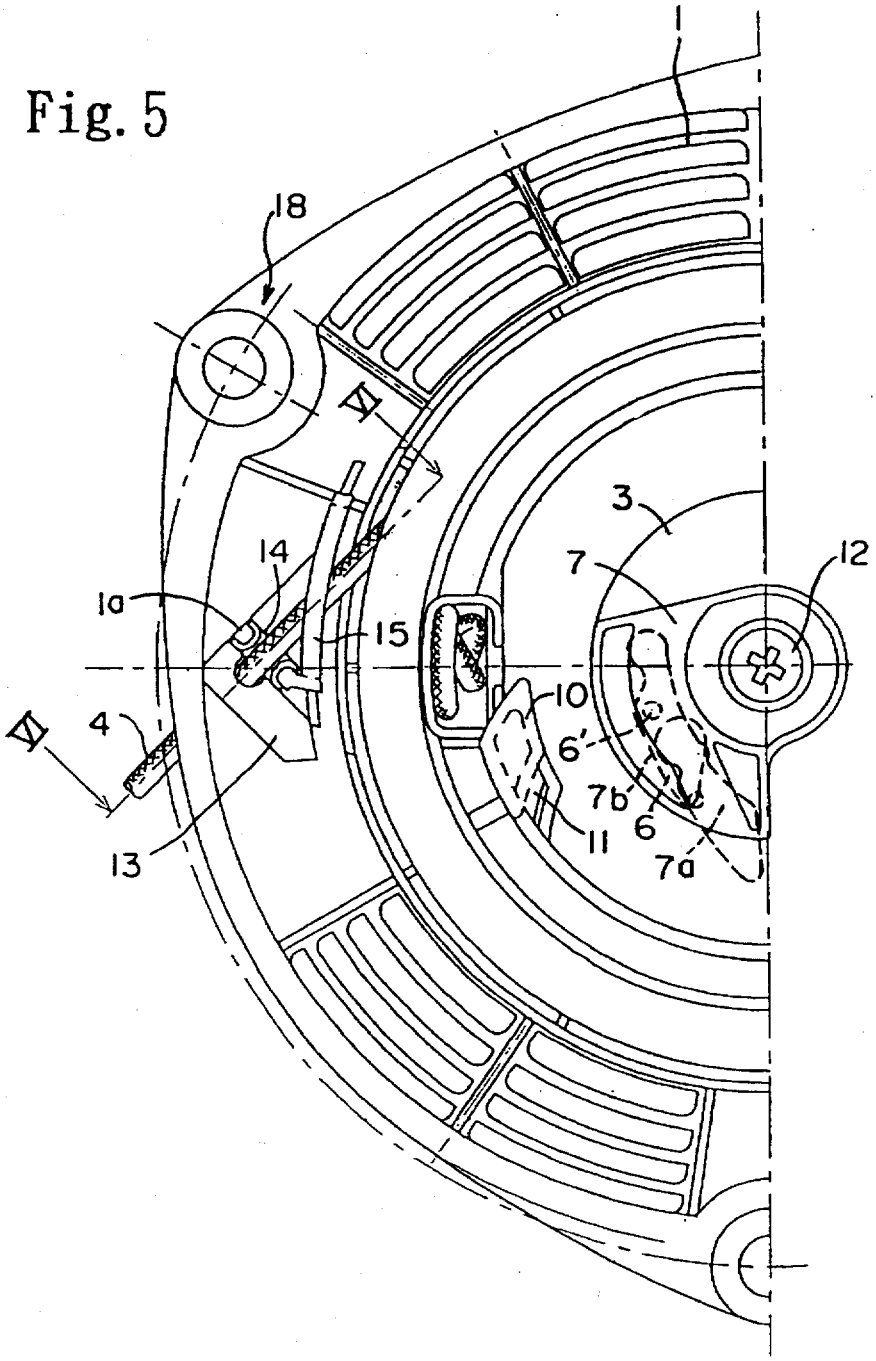
FIG. 5 is a partially cutaway bottom view of the recoil starter shown in FIG. 1.
Figure 6:
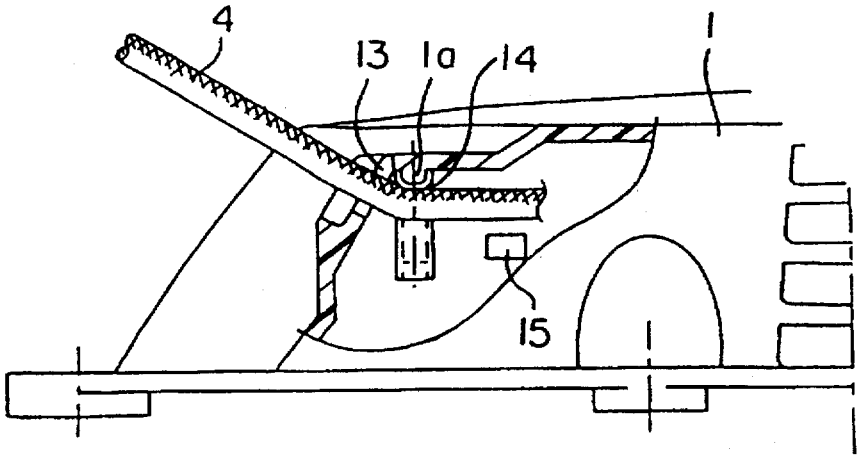
FIG. 6 is a cross-sectional view taken on line VI—VI of FIG. 5.
Figure 7A:
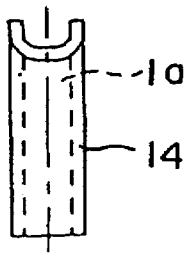
FIG. 7(*a*) is a side elevation of the rope guide shown in FIG. 6.
Figure 7B:
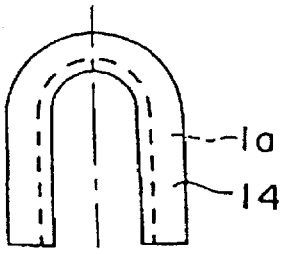

In addition, as shown in FIGS. 5–7, the rope takeout port 13 is formed in the outer surface of the starter case 1 to permit the rope 4 to be payed from the groove 3a in the outer surface of the reel 3 while tilted upwardly from the horizontal surface. The rope guide 14 for guiding the rope 4 is fitted over the starter case 1 between the rope takeout port 13 and the groove 3a in the reel 3, the guide 14 being made of a metal. As shown in FIGS. 7(*a*) and 7(*b*), the metal rope guide 14 is of a semicircular cross section. The rope guide 14 is fabricated from a concave metal material. The rope guide 14 is totally bent like the letter "U". The rope guide 14 is fitted over a convex member la formed integrally with the starter case 1 between the rope takeout port 13 and the groove 3a in the reel 3.

Further, the disengagement-preventive member 15 for preventing the rope 4 from coming off the reel 3 is mounted between the rope guide 14 and the groove 3a in the reel. As shown in FIGS. 5 and 6, this disengagement-preventive member 15 is bridged across the part of the rope 4 payed off from the groove 3a.

In this manner, in the novel construction, when the rope is pulled out for starting the engine, the rope 4 is guided by the rope guide 14. The disengagement-preventive member 15 bridges across the rope 4. Under this condition, the rope is pulled out smoothly obliquely upwardly with respect to the horizontal plane from the rope takeout port 13 formed in the starter case 1. The starting operation can be carried out easily. Furthermore, the rope 4 slides against only the inner surface of the metallic rope guide 14. Even if the starting operation is repeated, the starter case 1 is prevented from wearing or becoming damaged. Additionally, the rope 4 is prevented from disengaging from the reel 3. The starting operation can be continued stably and smoothly. Further, the recoil starter can be manufactured at low cost, because the rope guide 14 is easily fitted over the starter case 1.

In the present example, the totally U-shaped rope guide 14 is mounted. It is to be understood that the present invention is not limited to this example. For example, the rope guide may be made of a material of circular cross section, and the guide is bent into a substantially U-shaped form. Furthermore, the rope guide may be made of a metal material of concave, dish-shaped cross section. In addition, if the member 1a formed integrally with the starter case 1 is made concave, a rope guide made of a convex metal member of semicircular or disk-shaped cross section and totally shaped like the letter "U" may also be used.

In this structure, a cylindrical portion 1b is formed on the outer fringe of the resinous starter case 1 to place the recoil starter in position radially. The resinous fan cover 16 is provided with a cylindrical portion 16a that fits over the cylindrical portion 1b. These cylindrical portions 1b and 16a cooperate to form the positioning faucet joint 18. The cylindrical portion 16a fits over the cylindrical portion 1b, thus forming a subassembly. The plastic fastener 17 is mounted with a press fit in the center of the subassembly. In this way, the starter case 1 is mounted to the fan cover 16.

The plastic fastener 17 is provided with a head 17a of increased diameter and an engaging claw 17b located on the outer fringe of the cylindrical portion 16a. The head 17a is located on the fringe of the cylindrical portion 1b when the fastener 17 is mounted with a press fit in the subassembly. The distance between the surface of the head 17a opposite to the cylindrical portion 1b and the cylindrical portion 16a of the engaging claw 17b is set slightly shorter than the distance between the outer fringe of the cylindrical portion 1b and the outer fringe of the cylindrical portion 16a. When the plastic fastener 17 is mounted with a press fit in the subassembly, the fastener 17 strongly presses the cylindrical portion 1b and the cylindrical portion 16a against each other. Under this condition, the starter case 1 and the fan cover 16 are placed in position radially by the cylindrical portions 1b and 16a. The starter case 1 and the fan cover 16 are firmly held together. The starter case 1 and the fan cover 16 are rigidly locked together axially by the plastic fastener 17.

In this way, in the present example, when the plastic fastener 17 is mounted with a press fit in the subassembly, the starter case 1 and the fan cover 16 are placed in position radially and locked together firmly by the cylindrical portions 1b and 16a. The starter case 1 and the fan cover 16 are firmly held together axially by the plastic fastener 17 and so if starting operation of the engine performed by pulling out the rope 4 is repeated, the starter case 1 does not get loose from the fan cover 16. The staring operation can be continued stably and smoothly.

As described thus far, in the present invention, a reel is rotatably mounted to a resinous starter case. A rope is taken up on the reel by the restoring force of a spring. The rope is pulled out to rotate the reel. A ratchet pivoted to the reel moves close to the outer surface of the pulley. The front end of the pulley comes into engagement with the pulley. The pulley directly connected to an engine is rotated, thus starting it. A cover is formed integrally with a protrusion against which the rear surface of the front end of the ratchet bears. The cover is mounted near the outer surface of the reel. This cover limits movement of the ratchet in a direction perpendicular to one surface of the ratchet. Therefore, even if the protrusion or the front end of the ratchet is deformed slightly by repeated starting of the engine, it is unlikely that the ratchet moves out of engagement with the pulley. Hence, a resinous material having somewhat inferior rigidity can be used. This makes it possible to reduce the fabrication cost of the recoil starter.

Furthermore, in the present invention, a stem is mounted in the center of the starter case. A cylindrical engaging portion is formed on the outer surface of this shaft. One end of a spring is anchored to a slit formed in this engaging portion. The spring is wound around the engaging portion substantially precisely circularly. This enhances the durability of the spring. The rope is taken up on the reel, which is rotatably mounted to the starter case, by the restoring force of the spring. An internal combustion engine is started by pulling out the rope. The operating life through which the engine is started stably and smoothly is prolonged. Furthermore, the diameter of the stem of the starter is increased, thus adding to the strength.

In addition, in the present invention, a lower hole is formed in a boss mounted in the stem of the resinous starter case. A set screw has a head of increased diameter and a stem provided with a plurality of annular protrusions on its outer surface. The set screw is forced into the hole so as to push the inner fringe of a friction plate fitted over the boss. The annular protrusions are brought into firm engagement with the lower hole, thus locking the friction plate. Therefore, it is easy to hold the friction plate against the recoil starter. Furthermore, the state of this subassembly does not age. The operation for starting the engine by pulling out the rope can be stably, smoothly, and repeatedly carried out.

Moreover, in the present invention, a rope guide, preferably bent like the letter "U", for guiding a rope made of a hard material is fitted over the starter case between the rope takeout port and the reel. Therefore, the rope guide can be mounted at low cost by performing a simple fitting operation which is included in a flow process. The rope is taken out smoothly. If the operation for cranking the engine is repeated, the starter case of the recoil starter is neither worn nor damaged. A disengagement-preventive member for preventing the reel from coming off the reel is formed integrally with the starter case and located between the rope guide and the reel. Hence, it is unlikely that the rope loosens and disengages from the reel.

Further, in the present invention, a faucet joint for placing a resinous fan cover and a resinous starter case in position is mounted at a location where the fan cover and the starter case are coupled together. A plastic fastener is urged into the center position of the faucet joint so that the starter case is mounted to the fan cover. The starter case is placed and firmly held in position radially accurately relative to the fan cover by the faucet joint. The starter case is placed and firmly held in position axially accurately relative to the fan cover by the plastic fastener. Consequently, it is quite easy to perform the mounting operation. Additionally, the recoil starter is firmly mounted to the fan cover with high accuracy. Even if the engine is started repeatedly, the subassembly of the starter case and the fan cover does not loosen. The operation for starting the engine can be continued stably and smoothly.

What is claimed is:

1. A recoil starter comprising:

a starter case mounted to an engine and having a stem;

a reel rotatably mounted to the stem of said starter case and having an outer surface provided with a groove;

a rope received in said groove;

a rope takeout port formed in said starter case;

a spring having a first end engaging reel and a second end engaging said starter case, said spring acting to bias said reel in such a direction that the rope payed out from said rope takeout port is taken up;

a rotatable starting pulley mounted at a side of said engine;

a ratchet capable of rotating between its protruded position and its retracted position, said ratchet being fitted in such a way as to engage said pulley at said protruded position;

a friction plate for causing said ratchet to be protruded or retracted;

a friction spring biased against said friction plate so that said friction plate is frictionally rotated;

a boss mounted at a center of said stem of said starter case;

a set screw mounted to said boss;

a pivotal point about which said ratchet rotates, said pivotal point being located radially inside said pulley, said pivotal point being located around a position where said pulley and said ratchet engage each other when the ratchet is in its protruded position;

a ratchet support portion formed on said reel and located radially outside said pulley;

a beam supported at both ends, said beam being formed by the ratchet, said beam acting against a force of said pulley created by a resistance produced when said engine is started; and a movement limiting member mounted at an end of said support portion spaced from said reel to prevent said ratchet from moving toward a top end of said ratchet.

2. The recoil starter of claim 1, wherein a ratchet-receiving portion is formed between said reel and said movement limiting member at a top end of the ratchet support portion of said reel, and wherein an inner surface of said movement limiting member tapers off so that said ratchet-receiving portion widens outward.

3. A recoil starter comprising:

a starter case mounted to an engine and having a stem;

a reel rotatably mounted to the stem of said starter case and having an outer surface provided with a groove;

a rope received in said groove;

a rope takeout port formed in said starter case;

a take up spring having a first end engaging said reel and a second end engaging said starter case, said spring acting to bias said reel in such a direction that the rope payed out from said rope takeout port is taken up;

a rotatable starting pulley mounted at a side of said engine;

a ratchet capable of rotating between its protruded position and its retracted position, said ratchet being fitted in such a way as to engage said pulley at said protruded position;

a friction plate for causing said ratchet to be protruded or retracted;

a friction spring biased against said friction plate so that said friction plate is frictionally rotated;

a boss mounted concentrically at a center of said stem of said starter case;

a set screw mounted to said boss;

said friction plate and a ratchet guide containing said ratchet being mounted by said set screw to the center of said boss; and a cylindrical engaging portion formed as an axial slit in an outer concentric surface of said stem of said starter case, said take up spring being cylindrically wound around said engaging portion and having an end engaging said engaging portion.

4. The recoil starter of claim 3, wherein (A) said stem has a recess formed by said slit, (B) said slit is defined by two opposite walls one of which engages said spring, and (C) a tongue portion for guiding said spring is formed on the other of said two walls and tilted inwardly of said stem.

5. A recoil starter comprising:

a starter case mounted to an engine and having a stem;

a reel rotatably mounted to the stem of said starter case and having an outer surface provided with a groove;

a rope received in said groove;

a rope takeout port formed in said starter case;

a take up spring having a first end engaging reel and a second end engaging said starter case, said spring acting to bias said reel in such a direction that the rope payed out from said rope takeout port is taken up;

a rotatable starting pulley mounted at a side of said engine;

a ratchet capable of rotating between its protruded position and its retracted position, said ratchet being fitted in such a way as to engage said pulley at said protruded position;

a friction plate for causing said ratchet to be protruded or retracted;

a friction spring biased against said friction plate so that said friction plate is frictionally rotated;

a boss mounted at a center of said stem of said starter case;

a set screw mounted to said boss;

a cylindrical engaging portion formed on an outer surface of said stem of said starter case, said take up spring being cylindrically wound around said engaging portion and having an end engaging said engaging portion wherein said set screw has a head of an increased diameter and said system having an outer surface on which a plurality of annular protrusions are formed, and wherein said set screw is mounted with a press fit in a lower hole formed in said boss in the center of said stem of said starter case.

6. A recoil starter comprising:

a starter case mounted to an engine and having a stem;

a reel rotatably mounted to the stem of said starter case and having an outer surface provided with a groove;

a rope received in said groove;

a rope takeout port formed in the outer surface of said starter case such that said rope is payed out from said rope take out port while tilted upwardly from a horizontal plane;

a spring having a first end engaging reel and a second end engaging said starter case, said spring acting to bias said reel in such a direction that the rope payed out from said rope takeout port is taken up;

a rotatable starting pulley mounted at a side of said engine;

a ratchet capable of rotating between its protruded position and its retracted position, said ratchet being fitted in such a way as to engage said pulley at said protruded position;

a friction plate for causing said ratchet to be protruded or retracted;

a friction spring biased against said friction plate so that said friction plate is frictionally rotated;

a boss mounted at a center of said stem of said starter case;

a set screw mounted to said boss to assemble the whole starter;

a rope guide shaped like a letter "U" made of a hard material and fitted over said starter case between said rope takeout port and said reel, and a disengagement-preventive member for preventing said rope from coming off said reel formed integrally with said starter case between said rope guide and said reel.

7. A recoil starter comprising:

a starter case mounted to an engine and having a stem;

a reel rotatably mounted to the stem of said starter case and having an outer surface provided with a groove;

a rope received in said groove;

a rope takeout port formed in the outer surface of said starter case such that said rope is payed out from said rope take out port while tilted upwardly from a horizontal plane;

a spring having a first end engaging reel and a second end engaging said starter case, said spring acting to bias said reel in such a direction that the rope payed out from said rope takeout port is taken up;

a rotatable starting pulley mounted at a side of said engine;

a ratchet capable of rotating between its protruded position and its retracted position, said ratchet being fitted in such a way as to engage said pulley at said protruded position;

a friction plate for causing said ratchet to be protruded or retracted;

a friction spring biased against said friction plate so that said friction plate is frictionally rotated;

a boss mounted at a center of said stem of said starter case;

a set screw mounted to said boss to assemble the whole starter; and a rope guide made of a hard material and fitted over said starter case between said rope takeout port and said reel;

wherein a faucet joint is mounted at a location where said starter case is mounted to the engine to place said starter case in position relative to said engine, and wherein a plastic fastener is forced into a central position of said faucet joint such that said starter case is mounted to said engine.

* * * * *